United States Patent [19]

Coronato

[11] Patent Number: 4,791,746

[45] Date of Patent: Dec. 20, 1988

[54] VANDAL RESISTANT DISPLAY UNITS

[75] Inventor: Robert M. Coronato, Huntington Station, N.Y.

[73] Assignee: P.T.L. Equipment Co., Inc., Huntington, N.Y.

[21] Appl. No.: 664,888

[22] Filed: Dec. 23, 1983

[51] Int. Cl.[4] ..... G09F 3/04

[52] U.S. Cl. ..... 40/547; 40/580

[58] Field of Search ..... 40/547, 615, 628, 546, 40/583, 547, 580, 576

[56] References Cited

U.S. PATENT DOCUMENTS

| | | | |
|---|---|---|---|
| 362,820 | 5/1887 | Craige | 40/628 |
| 1,045,942 | 12/1912 | Burleigh | 40/576 |
| 1,054,274 | 2/1913 | Burleigh | 40/583 |
| 2,168,223 | 8/1939 | Lauve, Jr. | 40/576 |
| 2,310,665 | 2/1943 | Williams | 40/583 |
| 2,372,937 | 4/1945 | Dircksen et al. | 40/546 |
| 2,652,651 | 9/1953 | Barbera | 40/583 |
| 2,945,313 | 7/1960 | Hardesty | 40/546 |
| 3,811,211 | 5/1974 | Morgan | 40/628 |
| 4,310,974 | 1/1982 | Gdovin et al. | 40/547 |

*Primary Examiner*—Robert Peshock

*Assistant Examiner*—J. Hakomaki

*Attorney, Agent, or Firm*—Robin, Blecker & Daley

[57] ABSTRACT

A display device includes a component in the form of a plate bearing one or more display indicia on one plate surface and having a passage extending through the plate adjacent the display indicium. An integral light-transmissive element is fixedly secured in the plate passage and has a first lensed surface at one end adjacent the display indicium. At its opposite end, the light-transmissive element defines both a second lensed surface and a flat surface in abutting relation to a stepped part of the passage within the plate. The first lensed surface is convex relative to the light-transmissive element and the second lensed surface is concave relative to the light-transmissive element. The element, comprised of a polycarbonate film which is highly resistant to impact damage, is of dimension relative to the passage such that an interference-fit exists therebetween. The element is accordingly not removable by action thereon at the display surface, is not destructed by impact and cannot be forced against an interior light source, thereby providing a quite high degree of resistance to vandalism.

9 Claims, 1 Drawing Sheet

VANDAL RESISTANT DISPLAY UNITS

FIELD OF THE INVENTION

This invention relates generally to the illuminated display field and pertains more particularly to vandal-resistant illuminated display units.

BACKGROUND OF THE INVENTION

The illuminated display field, has in recent years, been impacted adversely by vandalism and related destructive activity, which has spawned an effort to provide what might be termed "vandal-resistant" display units.

Relatively simple destructive activity renders typical presently commercialized displays unusable. By way of example, elevator up/down indication is generally provided by an indirectly lit epoxy display in a metal plate adjacent the elevator station. The plate supports an elevator call button and the user is accomodated by prompt illumination of the epoxy display upon pressing the call bottom, which activates a lamp supported interiorly of the plate. Insertion of virtually any tool or sharp object into the epoxy display destroys the display and calls for full plate replacement.

SUMMARY OF THE INVENTION

The present invention has as its primary object the provision of improved illuminated display units.

A more particular object of the invention is to fulfill the need in the illuminated display field for effective vandal-resistant type display units.

In attaining the foregoing and other objects, the invention provides a display device component in the form of a plate bearing one or more display indicia on one plate surface and having a passage extending through the plate adjacent the display indicium. An integral light-transmissive element is fixedly secured in the plate passage and has a first lensed surface at one end adjacent the display indicium. At its opposite end, the light-transmissive element defines both a second lensed surface and a flat surface in abutting relation to a stepped part of the passage within the plate. The first lensed surface is convex relative to the light-transmissive element and the second lensed surface is concave relative to the light-transmissive element. The element, comprised of a polycarbonate film which is highly resistant to impact damage, is of dimension relative to the passage such that an interference-fit exists therebetween. The element is accordingly not removable by action thereon at the display surface, is not destructed by impact and cannot be forced against an interior light source, thereby providing a quite high degree of resistance to vandalism.

The foregoing and other objects and features of the invention will be further understood from the following detailed description of a preferred embodiment of the invention and from the drawings wherein like reference numerals identity like parts throughout.

DESCRIPTION OF THE PREFERRED EMBODIMENT AND PRACTICE

Figure 1:
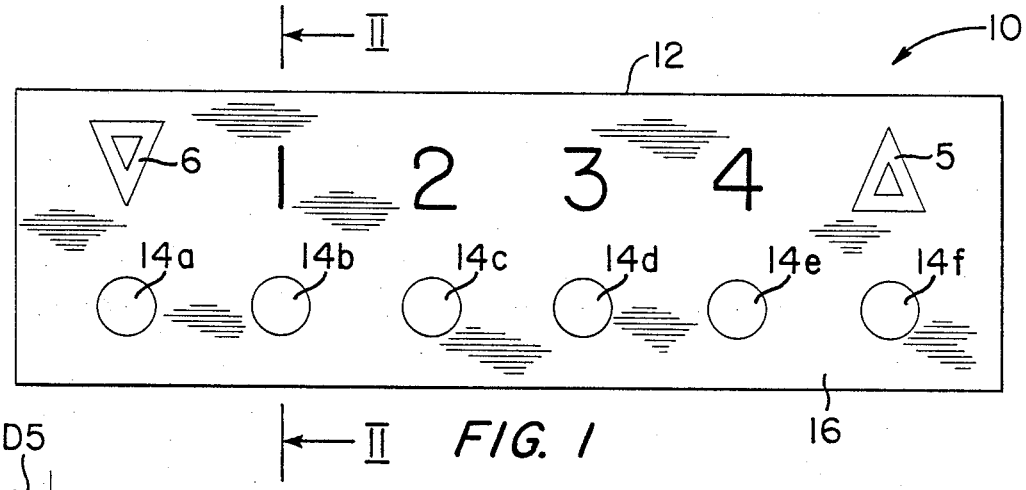
FIG. 1 is a front elevational view of a display unit in accordance with the invention.

Referring to FIG. 1, display unit 10, an elevator floor and direction indicator, includes a substrate 12, in the form of an aluminum or stainless steel plate, which has floor-indicating indicia 1–4, up-direction arrow indicium 5 and down-direction arrow indicium 6, all of indicia 1–6 typically being formed by indications in substrate 12 which are painted in color contrasting with the color of the indented surface of substrate 12. Lensed light-transmissive elements 14*a–f* are secured in substrate 12 in manner discussed below.

Substrate 12 has a first surface 16 (FIG. 2), forward in FIG. 1, and a second opposite surface 18. Passages extend through the substrate and open into surfaces 16 and 18, one such passage being shown in FIG. 2. This passage 20 has circular cross-section of dimension D1 in surface 16, and is of lesser cross-sectional dimension D2 in surface 18, being stepped therebetween.

Figure 3:
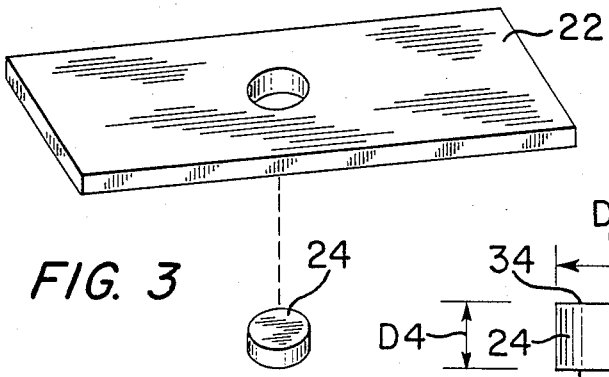
FIG. 3 is a perspective view of a light-transmissive sheet for use in providing light-transmissive elements for the FIG. 1 display unit showing, in exploded fashion, an unlensed element provided from the sheet.
Figure 4:
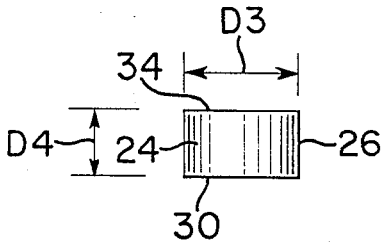
FIG. 4 is a front elevational view of the FIG. 3 unlensed element.
Figure 6:
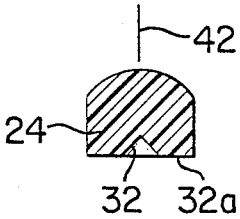
FIG. 6 is a sectional view of the FIG. 5 lensed element as would be seen from plane VI—VI of FIG. 5.
Figure 7:
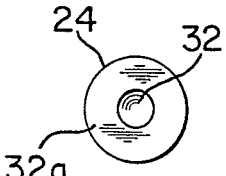
FIG. 7 is a bottom plan view of the FIG. 6 showing.

FIG. 3 depicts a sheet 22 of a polycarbonate plastic material sold commercially under the trademark LEXAN of General Electric Company. As indicated, a flat unlensed cylindrical piece 24 is taken from sheet 22 for preparation of each of lensed light-transmissive elements 14*a–f*. Piece 24 is inverted from its FIG. 4 orientation and is then gripped in a vise at its cylindrical sidewall 26, as shown by arrows 28 and 29 in FIG. 4. A deforming tool is now forcibly brought into contact with end 30 of piece 24 and displaces end 30 into dimpled configuration, thereby providing a first lensed end surface 32 (FIGS. 6 and 7) for piece 24, concave with respect to piece 24. The expanse of end 30 around surface 32 remains flat and provides a stop or abut surface 32*a*. By reason of the physical properties of the material constituting piece 24, such forcible contact of the tool with end 30 of piece 24 causes opposite end 34 thereof to be displaced from flat configuration into arcuate configuration, thereby providing a second lensed end surface 36 for piece 24, convex with respect to piece 24. Upon such working of piece 24, the piece may be said to have a body portion extending between opposed lensed end surfaces.

Figure 2:
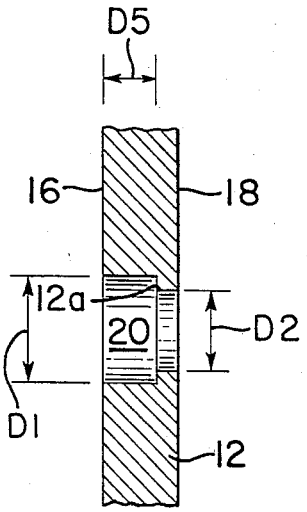
FIG. 2 is an enlarged partial sectional view of FIG. 1 display unit as would be seen from plane II—II of FIG. 1, the light-transmissive lensed elements in place.
Figure 5:
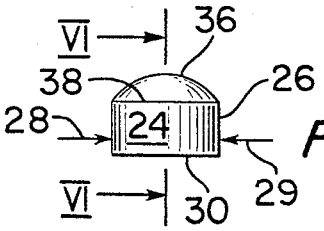
FIG. 5 is a front elevational view of a lensed element formed from the unlensed element of FIG. 4.

Diameter dimension D3 (FIG. 4) of piece 24 is selected to be slightly larger than cross-sectional demension D1 (FIG. 2) of the surface 16 opening of passage 20, such that upon insertion of piece 24 into plate 12, after the FIG. 5 tool working thereof, an interference fit relation exists as between piece 24 and substrate 12. Such insertion is done by disposing piece 24, as worked, with lensed end surface 32 in facing relation to opening 20. Lensed end surface 36 is now tapped with a rubber hammer or the like until stop surface 32*a* of piece 24 bottoms on interior surface or ledge 12*a* (FIG. 2) of substrate 12. Cylindrical axis dimension D4 of unlensed piece 24 is selected as not greater than and preferably less than the dimension D5 of ledge 12*a* below surface 16 of substrate 12 (FIG. 2). By this selection, the intersection surface 38 of lensed surface 36 and sidewall 26 of piece 24 is situated at or below surface 16 of substrate 12. This arrangement precludes access to any grippable surface of piece 24, i.e., access is only to lensed surface 36, since the rearward surface 18 of substrate 32, is in accessible based on the securement of substrate 12 to parent display unit structure. Accordingly, the invention effects a vandal-resistant display unit. In practice, it is found that efforts at gouging, marring, shattering or distorting the only accessible surface of piece 24 are ineffective to destroy piece 24 in its sheltered disposition in accordance with the invention and based on its material composition.

Figure 8:
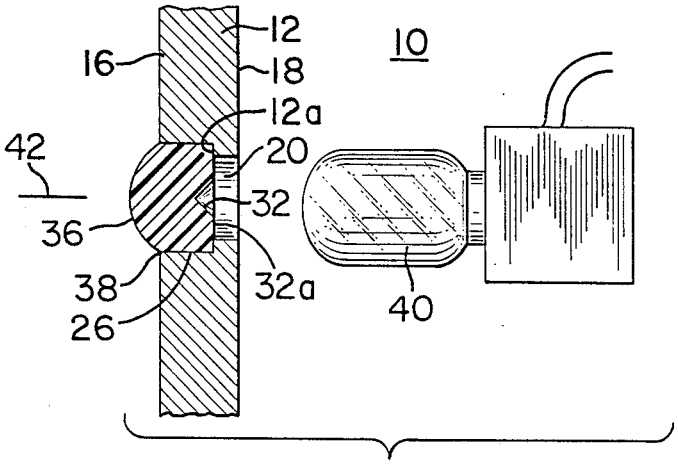
FIG. 8 is an enlarged partial sectional view of the FIG. 1 display unit as would be seen from plane II—II of FIG. 1 with its lensed light-transmissive elements in place and with a source of illumination situated in operative position.

Referring to FIG. 8, piece 24, as worked, is shown installed in the display unit as light-tranmissive element 14*b*, which receives light input from light source 40.

It is also found that the formation of the discussed plural lensed surfaces in accordance with the invention accomodates the frequent need for nonalignment of light sources and light-transmissive elements in display units. Thus, placement of light source 40 to the side of axis 42 of piece 24, e.g., below or above its FIG. 8 disposition, is found to effect superior issuance of light to a viewer of lensed surface 36 where the interior end of piece 24 is in lensed form as in the case of surface 32, rather than in flat configuration in FIG. 4, prior to FIG. 5 working.

As for the particularly effective composition of element 24, the LEXAN polycarbonate film is one having a tensile modulus of from 290,000 to 300,000 pounds per square inch at room temperature, a tear initiation of from 1150 to 1520 pounds per inch, and tear propogation of from 44 to 55 pounds per inch.

Various changes to the foregoing particularly described embodiment may be made without departing from the invention, as will be evident to those skilled in the art. Accordingly, the foregoing discussion and particularized showing are intended in an illustrative and not in a limiting sense. The true spirit and scope of the invention is set forth in the following claims.

I claim:

1. A display device component comprising:

a plate having a passage therethrough openings into first and second opposite surfaces of said plate, said plate having a display indicium on said first surface thereof; and an integral light-transmissive element fixedly secured in said passage and having a first lensed surface adjacent said plate first surface, a second lensed surface adjacent said plate second surface, and a body portion extending between said first and second lensed surfaces, said passage being stepped in said plate, said body portion having flat surface adjacent said second lensed surface in abutting relation to the step of said passage, said first lensed surface being convex with respect to said body portion and said second lensed surface being convex with respect to said body portion.

2. The invention claimed in claim 1 wherein said passage includes a first extent of first cross-sectional dimension and a second extent of second cross-sectional dimension less than thatof said first extent, said first passage extent opening into said plate first surface and said passage second extent opening into said plate second surface.

3. The invention claimed in claim 2 wherein said body portion is of configuration generally in conformance with said passage first extent.

4. The invention claimed in claim 3 wherein said body portion is fully resident in said passage first extent.

5. The invention claimed in claim 4 wherein first lensed surface extends at least in part outwardly of said plate first surface.

6. The invention claimed in claim 4 wherein said second lensed surface is disposed inwardly of said plate second surface.

7. The invention claimed in claim 1 wherein said body portion is in interference-fit with said plate and fully resident in said passage.

8. The invention claimed in claim 1 wherein said body portion has a sidewall extending between said first and second lens surfaces, the intersection surface of said first lensed surface and said sidewall being disposed interiorly of said first surface of said plate.

9. The invention claimed in claim 1 wherein said flat surface of said body portion includes a portion adjacent said second lensed surface in non-abutting relation with said step of said passage.

* * * * *

UNITED STATES PATENT AND TRADEMARK OFFICE

CERTIFICATE OF CORRECTION

PATENT NO. : 4,791,746

DATED : December 20, 1988

INVENTOR(S) : Robert M. Coronato

It is certified that error appears in the above-identified patent and that said Letters Patent is hereby corrected as shown below:

Item [21] change "664,888" to -- 564,888 --.
Col. 1, line 20, change "accomodated" to -- accommodated --.
Col. 1, line 59, change "identity" to -- identify --.
Col. 2, line 60, change "demen-" to -- dimen- --.
Col. 3, line 24, change "accomodates" to -- accommodates --.
Col. 4, line 1, change "openings" to -- opening --.
Col. 4, line 20, change "thatof" to -- that of --.
Col. 4, add the following dependent claims:

-- 10. The invention claimed in claim 1 wherein said light-transmissive element is comprised of a polycarbonate film having a tensile modulus of from 290,000 to 300,000 pounds per square inch at room temperature, tear initiation of from 1150 to 1520 pounds per inch and tear propagation of from 44 to 55 pounds per inch.

11. The invention claimed in claim 1 wherein said light-transmissive element is LEXAN polycarbonate film. --

On the title page, "9 Claims" should read -- 11 Claims --.

Signed and Sealed this

Sixth Day of June, 1989

*Attest:*

*Attesting Officer*

DONALD J. QUIGG

*Commissioner of Patents and Trademarks*